US008229326B2

(12) United States Patent
Anan

(10) Patent No.: US 8,229,326 B2
(45) Date of Patent: Jul. 24, 2012

(54) IMAGE FORMING APPARATUS AND METHOD OF SYNCHRONIZING IMAGE CARRIER ROTATIONS

(75) Inventor: Naohiro Anan, Osaka (JP)

(73) Assignee: KYOCERA Document Solutions Inc. (JP)

( * ) Notice: Subject to any disclaimer, the term of this patent is extended or adjusted under 35 U.S.C. 154(b) by 406 days.

(21) Appl. No.: 12/541,074

(22) Filed: Aug. 13, 2009

(65) Prior Publication Data

US 2010/0111565 A1 May 6, 2010

(30) Foreign Application Priority Data

Oct. 31, 2008 (JP) ..... 2008-282580

(51) Int. Cl.
*G03G 15/00* (2006.01)

(52) U.S. Cl. ..... 399/167; 399/301

(58) Field of Classification Search ..... 399/167, 399/301

See application file for complete search history.

(56) References Cited

U.S. PATENT DOCUMENTS

| | | | | |
|---|---|---|---|---|
| 6,408,157 | B1 * | 6/2002 | Tanaka et al. | 399/301 |
| 6,771,919 | B2 * | 8/2004 | Koide | 399/167 |
| 2003/0021613 | A1 * | 1/2003 | Koide | 399/167 |
| 2004/0131386 | A1 * | 7/2004 | Koide | 399/167 |
| 2006/0182465 | A1 * | 8/2006 | Funamoto et al. | 399/167 |
| 2007/0110477 | A1 * | 5/2007 | Handa et al. | 399/167 |
| 2011/0135342 | A1 * | 6/2011 | Maeda | 399/167 |

FOREIGN PATENT DOCUMENTS

JP 10-339976 12/1998

* cited by examiner

*Primary Examiner* — David Gray
*Assistant Examiner* — G. M. Hyder
(74) *Attorney, Agent, or Firm* — McDonnell Boehnen Hulbert & Berghoff LLP

(57) ABSTRACT

An image forming apparatus having a plurality of image carriers that are rotated in the same direction in synchronization with one another. The apparatus includes a detector that detects a rotational position on the each image carrier of the plurality of image carriers, a memory that stores a phase difference between a predetermined position and an eccentric position on each image carrier within the plurality of image carriers, and a controller that controls the eccentric positions on the circumferences of the image carriers to coincide with one another by using the phase differences stored in the memory.

20 Claims, 15 Drawing Sheets

[FIG.1]
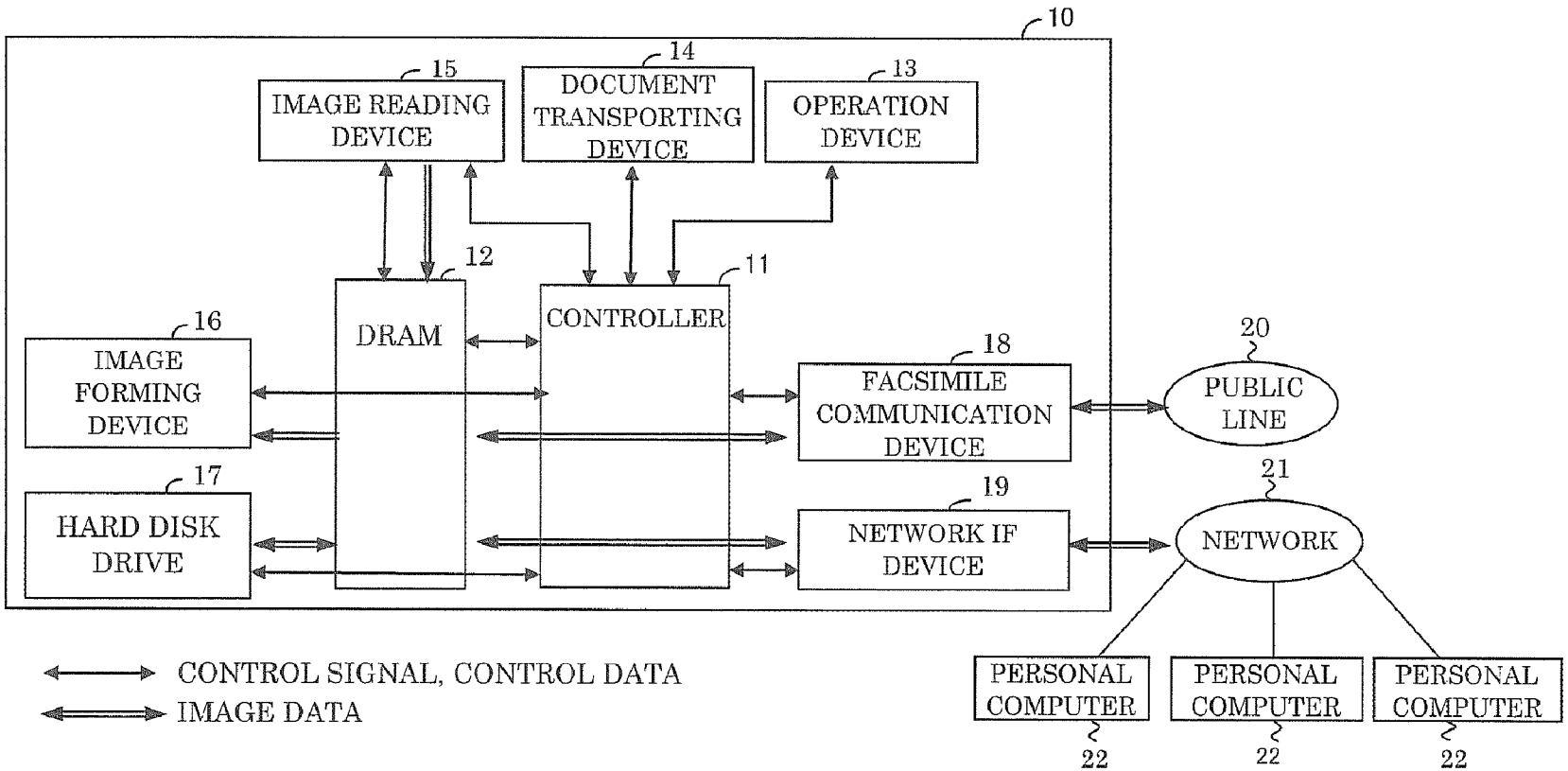

【FIG.2】
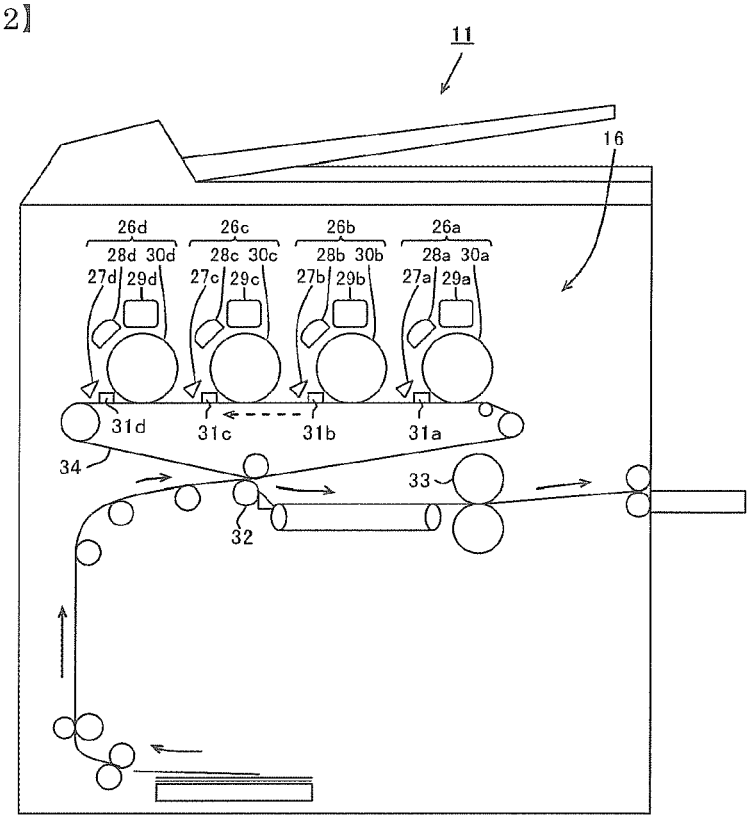
【FIG.3】
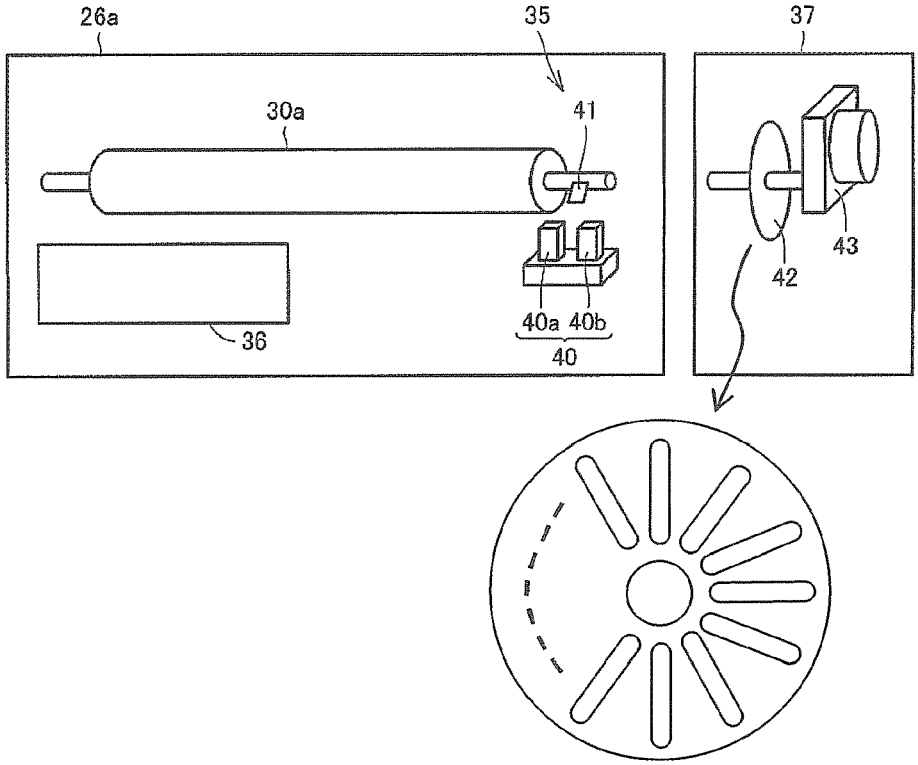

【FIG.4】
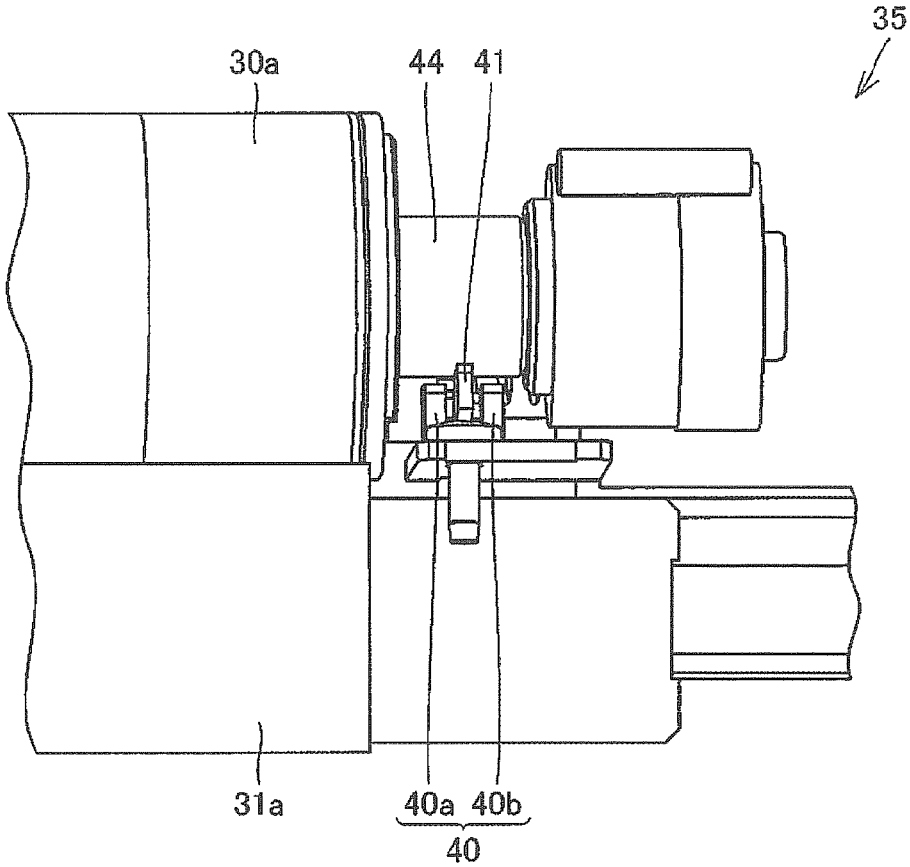
【FIG.5】
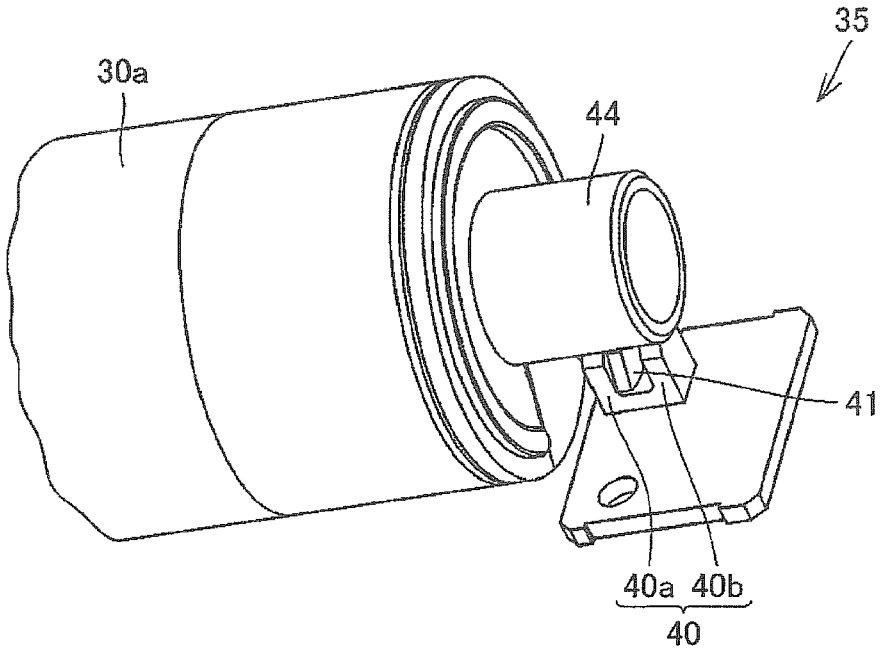

【FIG.6】
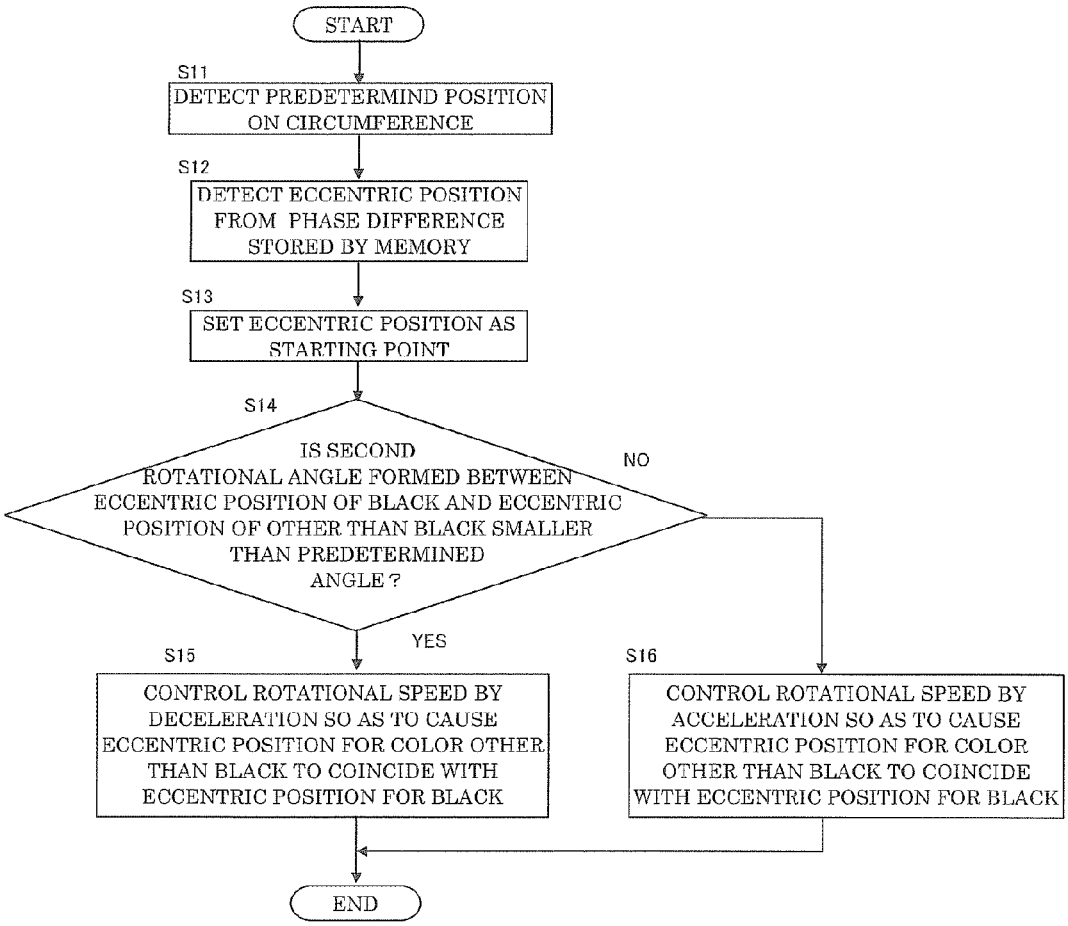

【FIG.7】
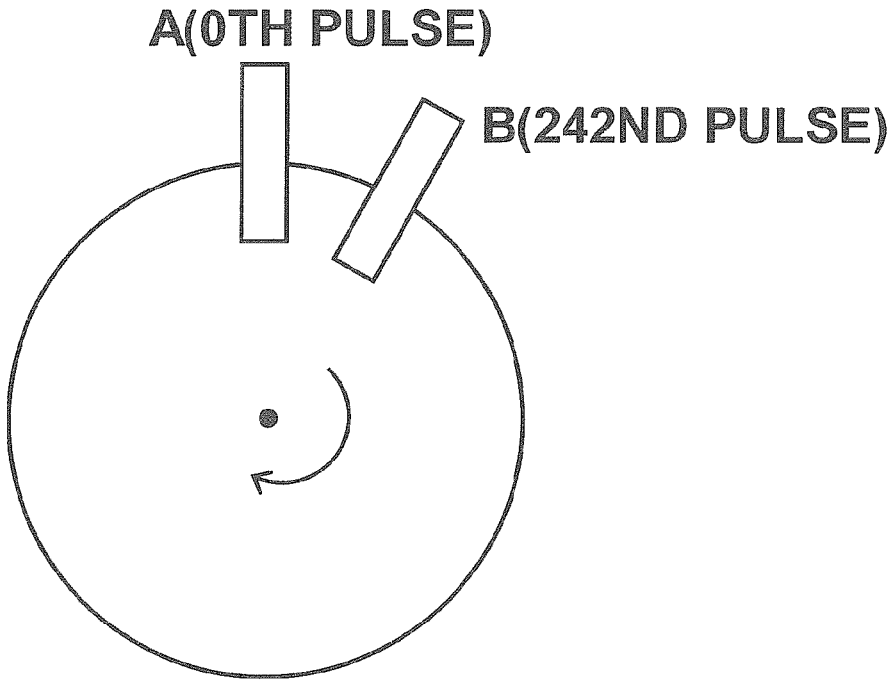
【FIG.8】
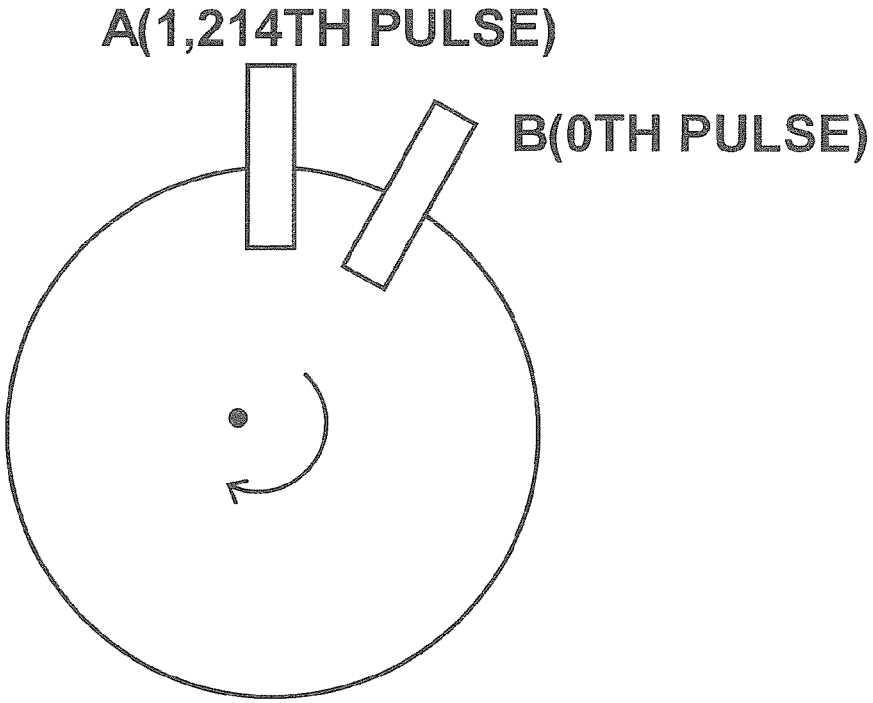

[FIG.9]
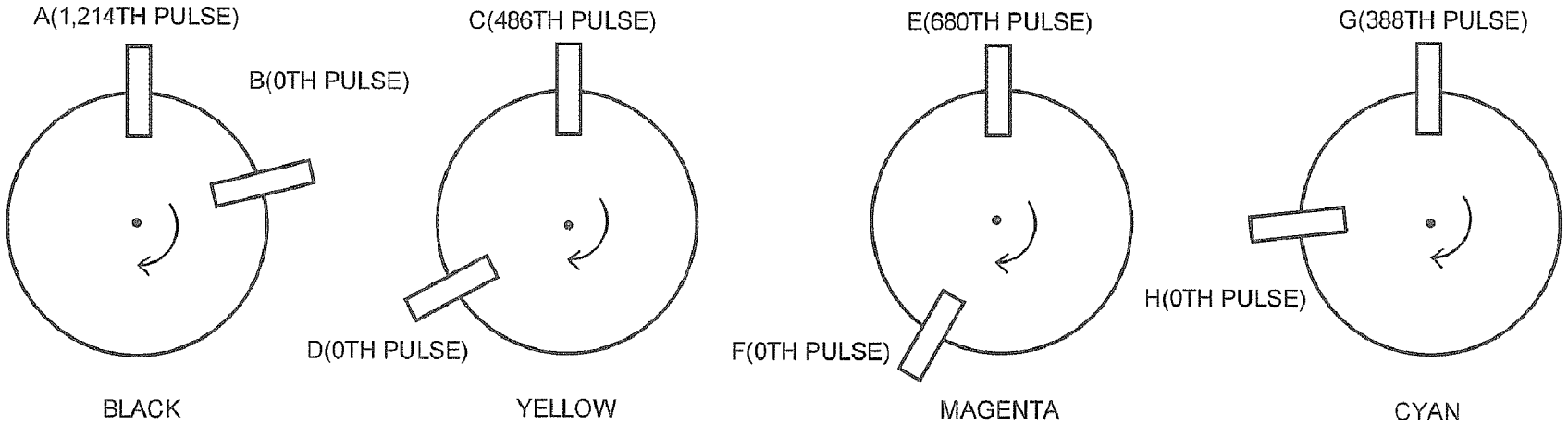

【FIG.10】
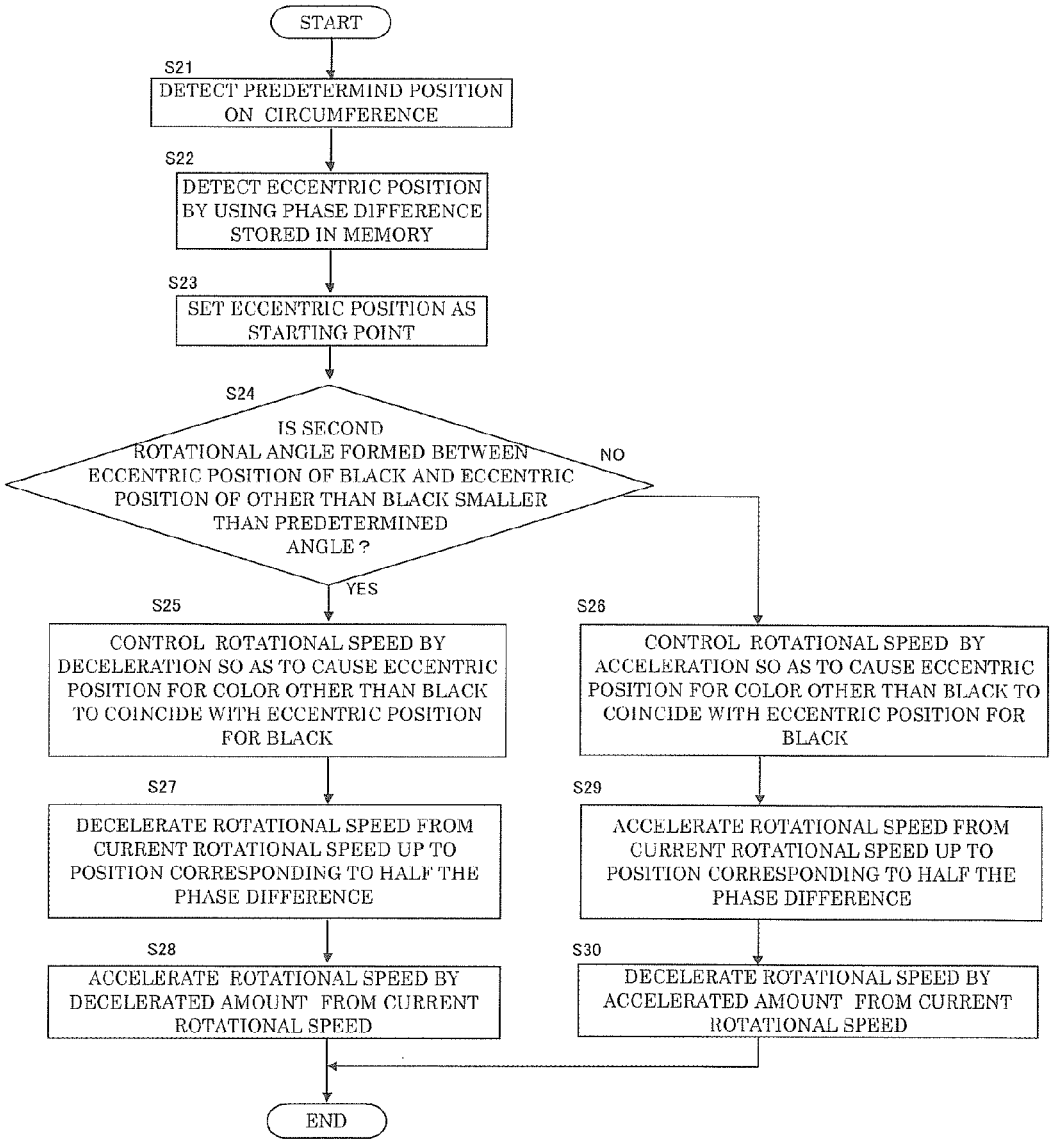

【FIG.11】
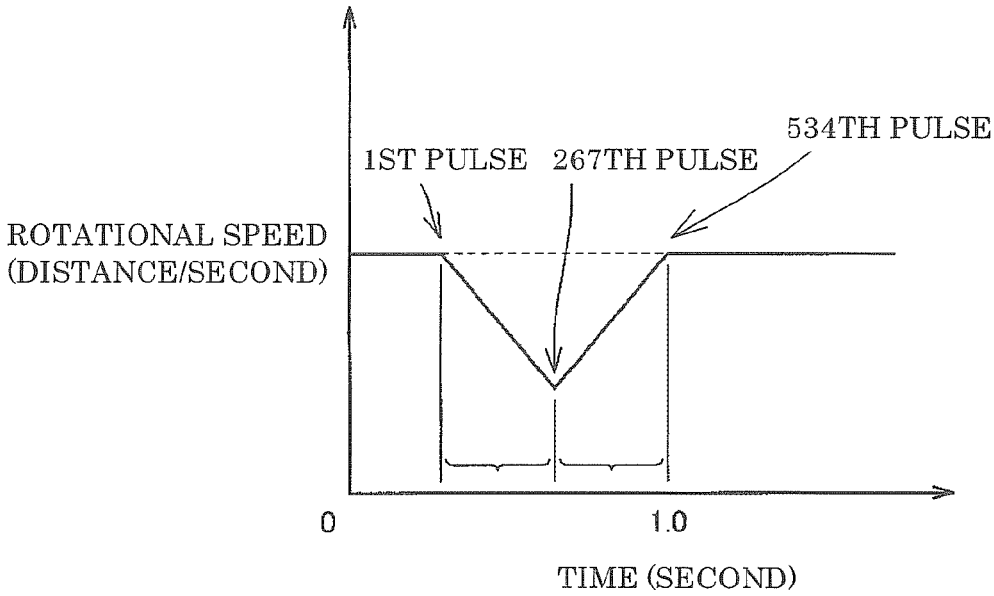
【FIG.12】
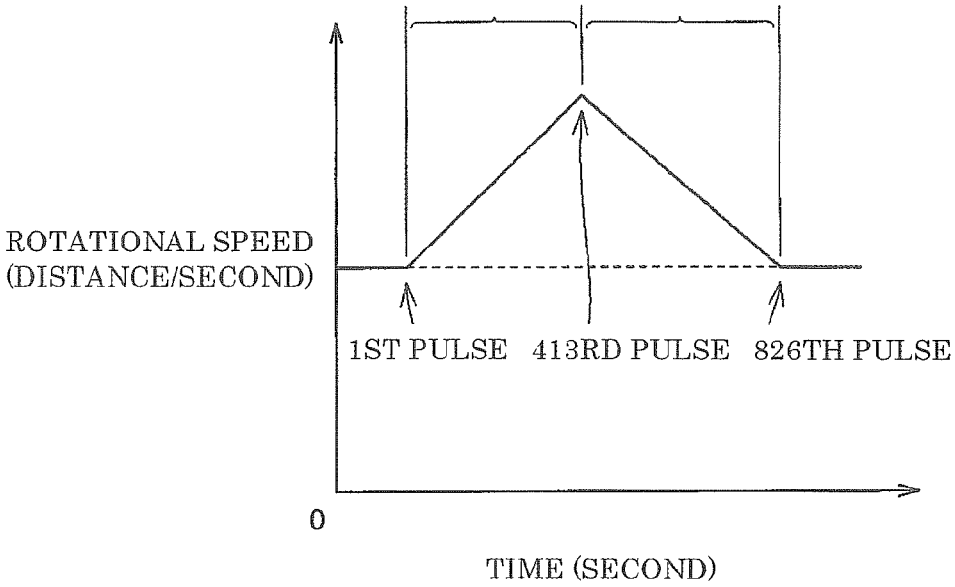

【FIG.13】
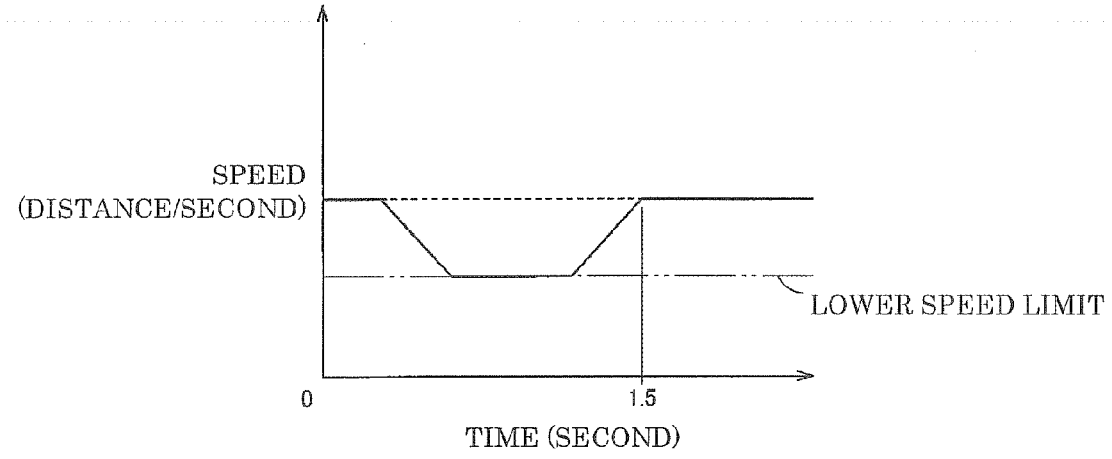

【FIG.14】
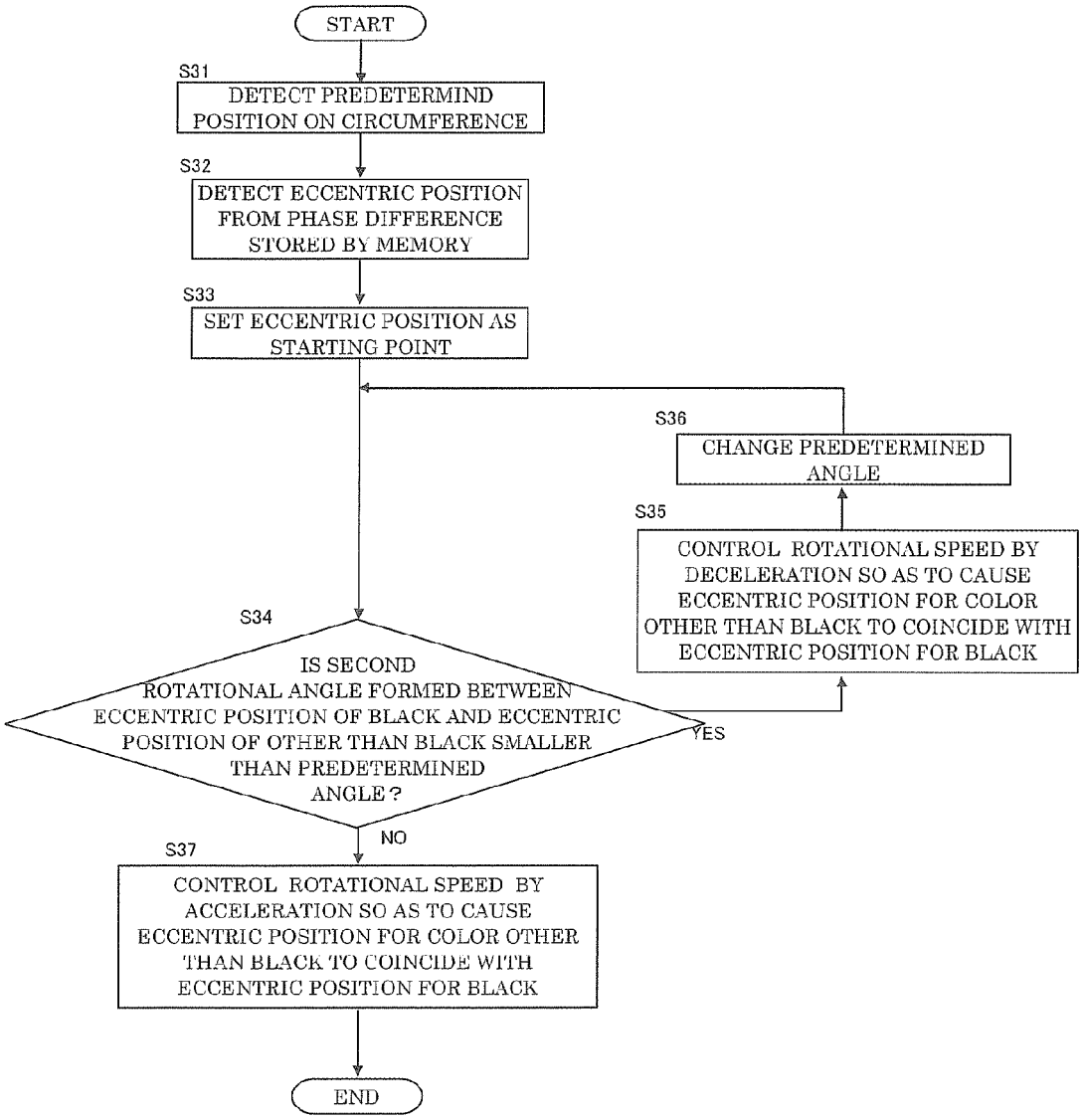

【FIG.15】
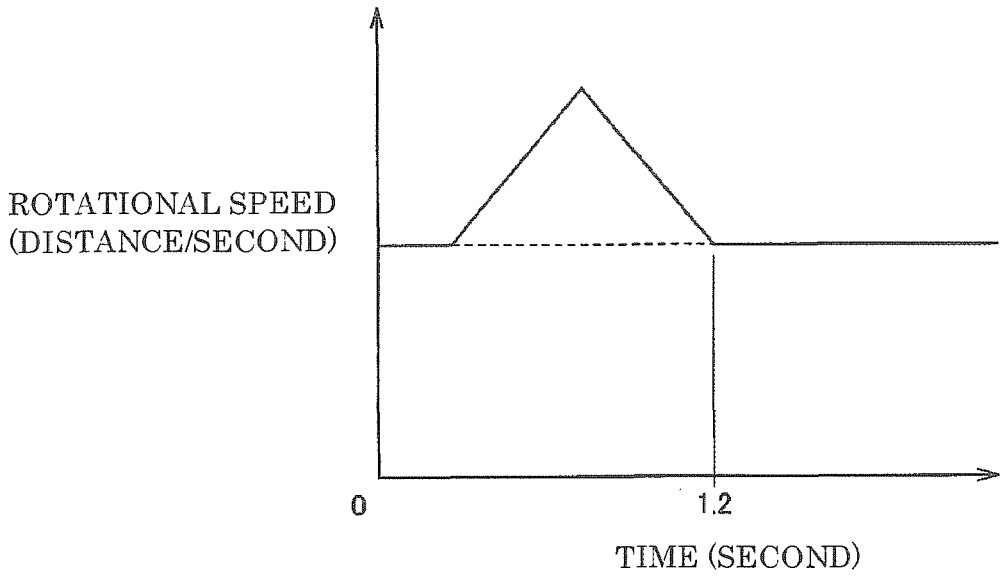

【FIG.16】
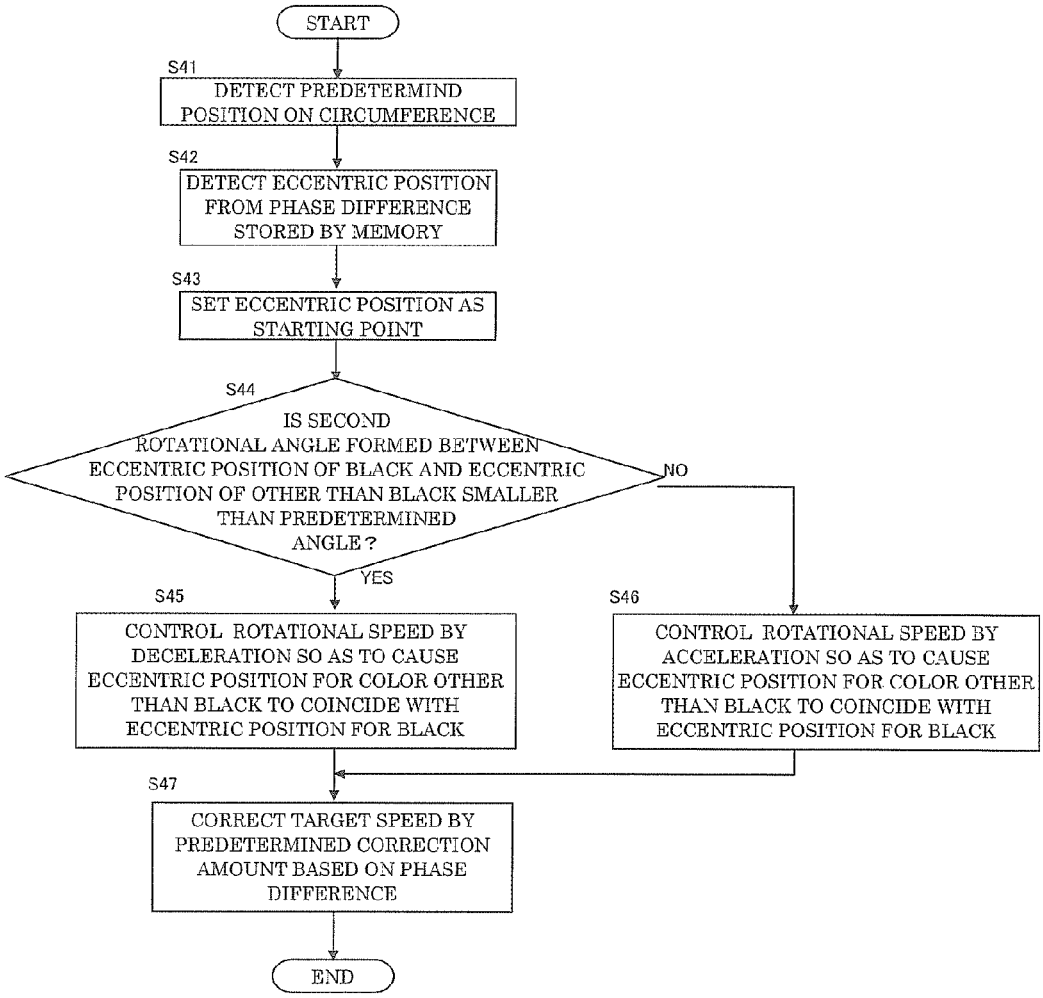

【FIG.17】

| ROTATIONAL SPEED | TARGET SPEED |
|---|---|
| AT LOWER SPEED | 22109 |
| ↓ | 7933 |
| | 5791 |
| | 4780 |
| | 4163 |
| AT NORMAL SPEED | 3736 |

【FIG.18】
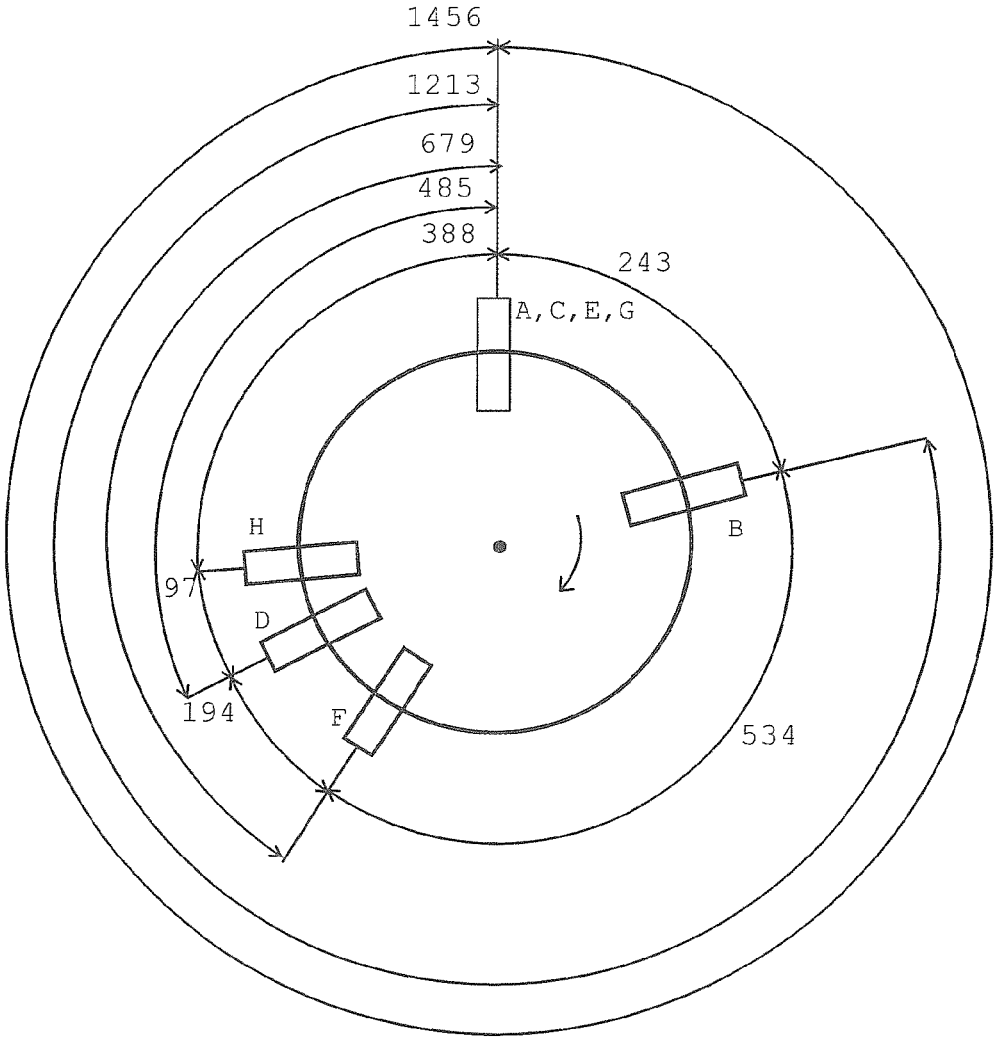

【FIG.19】
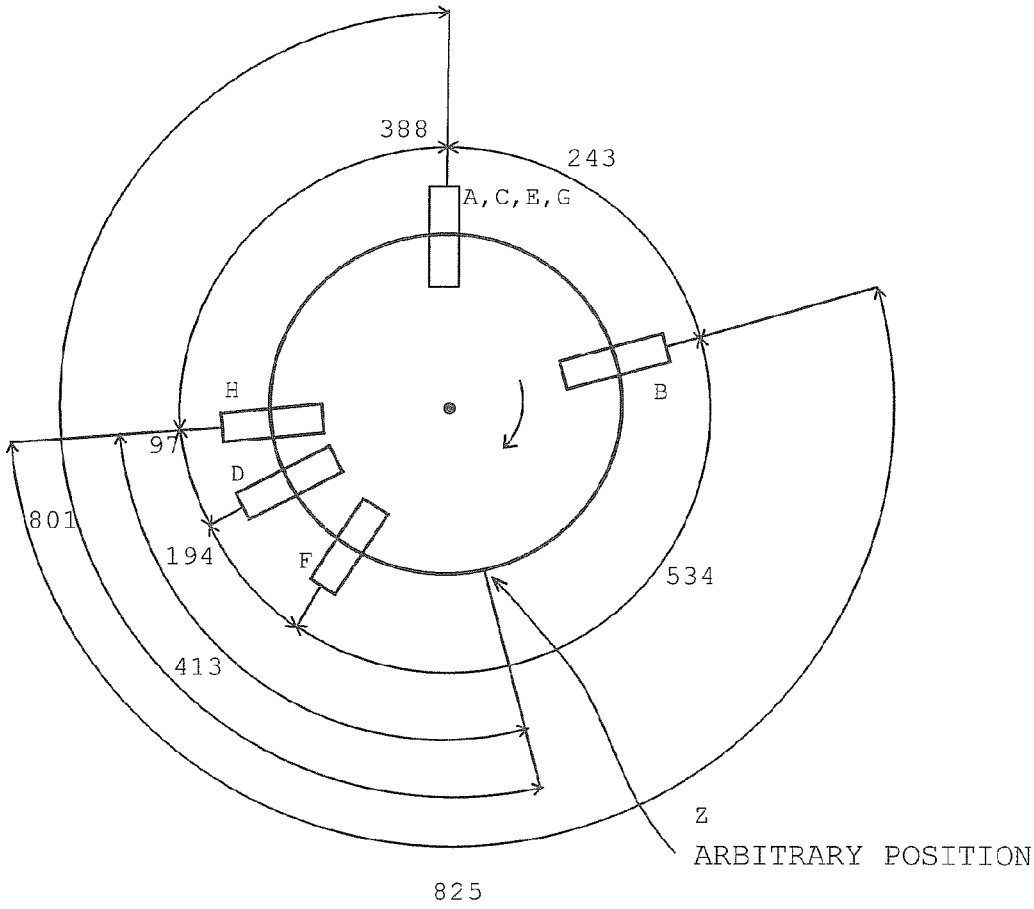

IMAGE FORMING APPARATUS AND METHOD OF SYNCHRONIZING IMAGE CARRIER ROTATIONS

INCORPORATION BY REFERENCE

This application is based upon and claims the benefit of priority from the corresponding Japanese Patent Application No. 2008-282580 filed on Oct. 31, 2008, the entire contents of which are incorporated herein by reference.

BACKGROUND OF THE INVENTION

1. Field of the Invention

The present invention relates to an image forming apparatus and a method of synchronizing rotations of image carriers, and in particular, an image forming apparatus including a plurality of photosensitive drums and a method of synchronizing rotations of photosensitive drums.

2. Description of the Related Art

An image forming apparatus is provided with developing members for respective colors of yellow, magenta, cyan, and black. A so-called tandem technique is employed, in which toner images in the respective colors are formed by those developing members and transferred onto a transfer belt by being overlapping with one another to thereby form a full-color image.

However, sometimes during operation the image carriers (e.g. photosensitive drums) may rotate with eccentricities (i.e. mutually-differing positions off-center) due to an operational error, for example. In that case, when the toner images are transferred onto the transfer belt by being overlapped with one another, misregistration occurs among the respective colors, which makes it difficult to form an appropriate image.

As described above, in conventional technology, in order to reduce displacement of each color due to eccentricities of each photosensitive drum, a phase mark is added to a smallest-radius direction position of each of the photosensitive drums. Then, the photosensitive drums are successively caused to stop rotating at timings at each of which a sensor detects that the phase mark has reached an uppermost direction. This allows a phase alignment of the plurality of photosensitive drums.

However, in such related art as described above, when the phase alignment is performed on each photosensitive drum, it is necessary to successively cause the photosensitive drums to stop rotating when each phase mark reaches the uppermost direction. Thus, the phase alignment may take much time using such an approach.

SUMMARY OF THE INVENTION

It is an object of the present invention to provide an image forming apparatus that is capable of appropriately performing a phase alignment on a plurality of image carriers in a short period of time.

Another object of the present invention is to provide a method of synchronizing rotations of image carriers, which is capable of appropriately performing a phase alignment on a plurality of the image carriers in a short period of time.

Thus, an image forming apparatus is disclosed that provides a plurality of image carriers that are rotated in the same direction in synchronization with one another. A first detector detects a predetermined position on the circumference of each image carrier within the plurality of image carriers. A memory stores a phase difference between the predetermined position and an eccentric position on the circumference of the each image carrier within the plurality of image carriers. A second detector detects a first rotational angle formed in a rotational direction of the image carriers. A controller controls the eccentric positions on the circumferences of the image carriers to coincide with one another among the plurality of image carriers by using the phase differences stored in the memory.

Additional features and advantages are described herein, and will be apparent from the following detailed description and figures.

BRIEF DESCRIPTION OF THE DRAWINGS

In the accompanying drawings:

FIG. 1 is a block diagram illustrating a configuration of a digital multifunction peripheral configured as an image forming apparatus according to an embodiment of the present invention;

FIG. 2 is a schematic diagram illustrating a portion of an image forming device;

FIG. 3 is a schematic diagram illustrating a yellow toner image forming unit and a yellow main body driving unit;

FIG. 4 is a perspective view illustrating a detector;

FIG. 5 is a perspective view illustrating the detector;

FIG. 6 is a flowchart illustrating a case where a phase alignment is performed on photosensitive drums for respective colors;

FIG. 7 is a diagram illustrating a predetermined position A and an eccentric position B on the photosensitive drum of black;

FIG. 8 is a diagram illustrating the predetermined position A and the eccentric position B, where positions A and B have been swapped;

FIG. 9 is a diagram illustrating predetermined positions and eccentric positions on the photosensitive drums for respective colors of black, yellow, magenta and cyan;

FIG. 10 is a flowchart illustrating another embodiment;

FIG. 11 is a diagram illustrating a change of a rotational speed exhibited in a case where a deceleration amount is set to be equal to an acceleration amount;

FIG. 12 is a diagram illustrating a change of the rotational speed exhibited in the case where the deceleration amount is set to be equal to the acceleration amount;

FIG. 13 is a diagram illustrating a change of the rotational speed exhibited in the case as illustrated in FIG. 11 where the deceleration amount of the photosensitive drum for magenta is set to be equal to the acceleration amount thereof and in a case where a lower speed limit is set;

FIG. 14 is a flowchart illustrating yet another embodiment;

FIG. 15 is a diagram illustrating a change of the rotational speed exhibited in the case where the deceleration amount of the photosensitive drum for magenta is set to be equal to the acceleration amount thereof and in a case where the phase alignment is performed by accelerating the rotational speed;

FIG. 16 is a flowchart illustrating a case where the phase alignment is performed by synchronizing the eccentric positions of the photosensitive drums for the respective colors during a start-up time for the image forming apparatus;

FIG. 17 is a table illustrating target speeds;

FIG. 18 illustrates the eccentric positions of image carriers; and

FIG. 19 illustrates the eccentric positions with an arbitrary position Z.

DETAILED DESCRIPTION OF THE PREFERRED EMBODIMENT

The accompanying drawings set forth an embodiment of the present invention. FIG. 1 is a block diagram illustrating a digital multifunction peripheral 10 configured as an image forming apparatus according to the embodiment of the present invention. A shown in FIG. 1, the digital multifunction peripheral 10 includes: a controller 11 for controlling an entirety of the digital multifunction peripheral 10 and a DRAM 12 for performing writing and reading of image data and the like. The digital multifunction peripheral 10 further includes an operation device 13 having a display screen for displaying information stored on the digital multifunction peripheral 10, which serves as a user interface on the digital multifunction peripheral 10, a document transporting device 14 for automatically transporting a document to a predetermined document reading position, and an image reading device 15 for reading an image of the document that has been transported by the document transporting unit 14 at the predetermined document reading position. Still further, the digital multifunction peripheral 10 includes an image forming device 16 for forming the image from the document read by the image reading device 15 or other such an image and a hard disk drive 17 for storing the image data or the like. Finally, the digital multifunction peripheral 10 includes a facsimile communication device 18 for establishing a connection with a public line 20 and a network interface (IF) device 19 for establishing a connection with a network 21.

The controller 11 compresses and encodes document data supplied from the image reading device 15, writes the data into the DRAM 12, reads the data written into the DRAM 12, expands and decodes the data, and outputs the data to the image forming device 16.

The digital multifunction peripheral 10 operates as a copier by using the document read by the image reading device 15 to form an image on the image forming device 16 via the DRAM 12. In addition, the digital multifunction peripheral 10 operates as a printer by using image data transmitted from a personal computer 22 connected to the network 21 through the network IF device 19 to form an image on the image forming device 16 via the DRAM 12. Further, the digital multifunction peripheral 10 operates as a facsimile apparatus by using image data transmitted from the public line 20 through the facsimile communication device 18 to form an image on the image forming device 16 via the DRAM 12 and by transmitting image data on a document read by the image reading device 15 to the public line 20 through the facsimile communication device 18.

In other words, the digital multifunction peripheral 10 has multiple image-processing-related detailed functions such as a copy function, a printer function and a facsimile function.

Note that in FIG. 1, double-headed thick arrows each indicate a flow of image data, and double-headed thin arrows each indicate a flow of a control signal or control data.

FIG. 2 is a schematic diagram illustrating a partial structure of the image forming device 16. In FIG. 2, solid arrows indicate a flow of paper and a dotted arrow indicates a rotation direction of a transfer belt. Referring to FIGS. 1 and 2, the image forming device 16 includes toner image forming parts 26*a* to 26*d* for respective colors of yellow, magenta, cyan, and black, and main body driving portions for the respective colors (not shown in FIG. 2).

The following is a description of the toner image forming part 26*a* for the color yellow. Note that the toner image forming parts 26*b* to 26*d* for the other colors are structured in the same manner, and hence description thereof is omitted.

First, the toner image forming unit 26*a* of yellow includes a photosensitive drum 30*a*, a charging member 27*a*, an exposure member 28*a*, a developing member 29*a*, and a cleaning member 31*a*. After the charging member 27*a* applies a voltage to the photosensitive drum 30*a* to cause a surface thereof to be charged to a predetermined potential, the exposure member 28*a* exposes an optical image for yellow to the surface of the photosensitive drum 30*a*. This causes an electrostatic latent image to be formed on the surface of the photosensitive drum 30*a*.

Then, the developing member 29*a* causes yellow toner to adhere onto the electrostatic latent image to form a toner image in yellow. In the same manners, the toner image forming units 26*b* to 26*d* for the other colors of magenta, cyan, and black, respectively, form toner images in the respective colors.

Then, the toner images in the respective colors are primarily transferred onto a transfer belt 34 that is rotating in a direction indicated by the dotted arrow of FIG. 2 by being overlapped with one another in order of yellow, magenta, cyan, and black so as to prevent misregistration. At this time, photosensitive drums 30*a* to 30*d* for the respective colors synchronously rotate in the same direction. Then, the cleaning member 31*a* removes residual toner and the like on the surface of the photosensitive drum 30*a*, and prepares for formation of a subsequent image.

Note that a color image formed on the transfer belt 34 is secondarily transferred onto paper by transfer rollers 32, and fixed by fixing rollers 33. Accordingly, the color image is formed on the paper.

The toner image forming unit 26*a* for yellow further includes a first detector 35 and a memory 36. FIG. 3 is a schematic diagram illustrating the toner image forming unit 26*a* for yellow and a main body driving member 37 for yellow.

The first detector 35 includes a photo interrupter (PI) sensor 40 and a light blocking plate 41. FIGS. 4 and 5 are perspective views illustrating the first detector 35. As shown in FIGS. 1 to 5, the PI sensor 40 is positioned at the cleaning member 31*a* and includes a light-emitting side member 40*a* having a light-emitting surface that irradiates light and a light-receiving side member 40*b* having a light-receiving surface for receiving the light irradiated from the light-emitting surface. The light-emitting surface and the light-receiving surface are situated so as to be opposed to each other.

The light blocking plate 41 is positioned on a cylindrical-shaped flange member 44 that is positioned at a longitudinal end of the photosensitive drum 30*a*. The light blocking plate 41 is shaped to protrude from an outer diameter surface of the flange member 44 outward along a radial direction thereof, and is positioned in a predetermined position on a circumference of the flange member 44.

Further, the light blocking plate 41 is colored black. When the photosensitive drum 30*a* is rotated, the light blocking plate 41 is brought to a position between the light-emitting surface and the light-receiving surface of the PI sensor 40, to block the light irradiated from the light-emitting surface without allowing the light-receiving surface to receive the light. As a result, a predetermined position on a circumference of the photosensitive drum 30*a* is detected.

In other words, the predetermined position is a position in which the light is blocked by the light blocking plate 41, and is a reference position serving as a reference for a rotation angle of the photosensitive drum 30*a*. Further, only one position on the circumference is set as the predetermined position. Here, the PI sensor 40 and the light blocking plate 41 operate as position detector.

Further, the flange member 44 and the photosensitive drum 30*a* are joined to each other by an adhesive or the like. This may prevent a looseness or the like due to a joint between the flange member 44 and the photosensitive drum 30*a*.

The memory 36 stores an eccentric position located on the circumference of the photosensitive drum 30*a*. The eccentric position represents a position that is located approximately the furthest from the rotational center (which may differ from the geometric center), compared to other positions on the circumference of the photosensitive drum 30*a*. The most effective eccentric position in the present embodiment is a position exhibiting the maximum difference between the rotational center and the circumference of the photosensitive drum 30*a* (i.e. the furthest circumferential position from the rotational center).

Specifically, with an entire circumference of the photosensitive drum being divided into 30 segments at regular intervals, the memory 36 stores how many segments there are up to the eccentric position along the rotation direction starting from the predetermined position detected by the PI sensor 40. In other words, using the 30 segments obtained by dividing the entire circumference of the photosensitive member, the memory 36 stores a phase difference between the predetermined position detected by the PI sensor 40 and the eccentric position (see FIG. 3). Thus, the memory 36 operates as memory means.

The main body driving member 37 for yellow will now be described. Note that the main body driving portions for the other colors are structured in the same manner, and hence description thereof is omitted.

First, the main body driving portion 37 for yellow includes an encoder 42 and a motor 43 operating as a driving means for rotating the photosensitive drum 30*a*.

The encoder 42 has a rotation shaft and outputs a pulse signal according to the rotation angle of the photosensitive drum 30*a*.

The motor 43 has its rotation controlled based on a control signal output in response to an instruction from the controller 11 and a rotation signal output by the rotation of the motor 43. Thus, the pulse signal output by the encoder 42 is associated with the rotation angle of the photosensitive drum 30*a*.

The motor 43 and the encoder 42 are arranged along the same axis as the rotation shaft, for detecting the rotation angle of the photosensitive drum 30*a*. Specifically, when a pulse signal generated while the photosensitive drum 30*a* is being rotated one round contains 1,456 pulses, the rotation angle of the photosensitive drum 30*a* is detected by judging how many pulses of the 1,456 pulses have been emitted since the photosensitive drum 30*a* started its rotation at the predetermined position detected by the PI sensor 40. As a result, the encoder 42 operates as angle detector.

The eccentric positions of the photosensitive drums 30*a* to 30*d* for the respective colors vary from one another. In other words, the phase difference between the predetermined position detected by the PI sensor 40 and the eccentric position varies among the photosensitive drums 30*a* to 30*d* for the respective colors. In the example described for this embodiment, it is assumed that the predetermined positions are determined to be positioned at the uppermost of the circumferences and the phase difference of black is 5 segments. Then, the eccentric position of black corresponds to the (5×1,456÷30=) 243rd pulse counted from the reference position. Further, assuming that the phase difference of yellow is 20 segments, the eccentric position of yellow corresponds to the (20×1,456÷30=) 971st pulse. Further, assuming that the phase difference for magenta is 16 segments, the eccentric position of magenta corresponds to the (16×1,456÷30=) 777th pulse. Further, assuming that the phase difference of cyan is 22 segments, the eccentric position of cyan corresponds to the (22×1,456÷30=) 1,068th pulse.

The following description sets forth a case where, in a normal state, the eccentric positions of the photosensitive drums 30*a* to 30*d* for the respective colors are synchronized, and a phase alignment is performed on the photosensitive drums 30*a* to 30*d* for the respective colors. FIG. 6 is a flowchart illustrating a case where the phase alignment is performed on the photosensitive drums 30*a* to 30*d* for the respective colors. FIGS. 1 to 6 describe phase alignment of the photosensitive members 30*a* to 30*d* for the respective colors in the normal state. Note that the normal state refers to a state in which the motor 43 is being rotated at a normal speed that allows image formation.

FIG. 7 is a diagram illustrating a predetermined position A and an eccentric position B on the photosensitive drum 30*d* of black. In FIG. 7, the arrow indicates the rotation direction. First, the controller 11 causes the PI sensor 40 to detect the predetermined position A on the circumference of the photosensitive drum 30*d* of black (Step S11 of FIG. 6; note that the prefix "Step" is omitted hereinafter). Further, the controller 11 detects the eccentric position B from the phase difference stored by the memory 36 (S12). In this embodiment, the eccentric position B corresponds to the 242nd pulse.

Then, the eccentric position B is replaced by the 0th pulse of the 1,456 pulses (S13). In other words, the eccentric position B is set as a starting point. Specifically, the 243rd pulse is replaced by the 0th pulse, and the original 0th pulse is replaced by the (1,456−243=) 1213rd pulse. In other words, the 0th pulse corresponds to the eccentric position B, and the 1213rd pulse corresponds to the predetermined position A. FIG. 8 is a diagram illustrating the predetermined position A and the eccentric position B that have been replaced.

In the same manner, predetermined positions and eccentric positions are detected from the photosensitive drums 30*a* to 30*c* for the other colors of yellow, magenta, and cyan, respectively. FIG. 9 is a diagram illustrating the predetermined positions and the eccentric positions on the photosensitive drums 30*a* to 30*d* for the respective colors of yellow, magenta, cyan and black, respectively. Referring to FIG. 9, on the photosensitive drum 30*a* of yellow, the 0th pulse corresponds to an eccentric position D, and the (1,456−971=) 485th pulse corresponds to a predetermined position C. Further, on the photosensitive drum 30*b* for magenta, the 0th pulse corresponds to an eccentric position F, and the (1,456−777=) 679th pulse corresponds to a predetermined position E. On the photosensitive drum 30*c* for cyan, the 0th pulse corresponds to an eccentric position H, and the (1,456−1,068=) 388th pulse corresponds to a predetermined position G.

Then, by using the eccentric position B of black as a reference, the controller 11 controls the eccentric positions D, F, and H for the other colors of yellow, magenta, and cyan, respectively, to coincide with the eccentric position B of black. In other words, the controller 11 synchronizes the eccentric positions of the photosensitive drums 30*a* to 30*d* for the respective colors. Here, the photosensitive drum 30*d* of black is a first photosensitive drum serving as the reference with which the eccentric position is caused to coincide, and the photosensitive drums 30*a* to 30*c* of yellow, magenta, and cyan, respectively, are second photosensitive drums that operate in synchronization with the first photosensitive drum. Here, the controller 11 operates as control means.

First, with respect to the photosensitive drum 30*a* for yellow, the controller 11 determines whether or not the second rotational angle formed between the eccentric position (B) of black and the eccentric position (D) of yellow is smaller than the predetermined angle in the rotation direction (S14). In this embodiment, the predetermined rotating angle is set as 180° (a semicircle), that is, (1,456÷2=) 728 pulses, and the controller 11 determines whether or not the phase difference between the eccentric position B of black and the eccentric position D of yellow is smaller than 728 pulses. Here, the controller 11 operates as judging means.

Specifically, the second rotational angle formed (i.e. a phase difference) between the eccentric position B of black and the eccentric position D of yellow is calculated. The controller then causes the number of pulses corresponding to the predetermined position A with respect to the eccentric position B of black (1213 pulses) to coincide with the number of pulses corresponding to the predetermined position C with respect to the eccentric position D of yellow (485 pulses). Therefore, the phase difference is (1213−485=) 728 pulses because the predetermined position A with respect to the eccentric position B of black corresponds to the 1213rd pulse, and the predetermined position C with respect to the eccentric position D of yellow corresponds to the 485th pulse. Accordingly, it is determined that the second rotational angle formed between the eccentric position B of black and the eccentric position D of yellow is smaller than the predetermined angle formed from the eccentric position B in the rotation direction (YES in S14).

Subsequently, a rotational speed of the photosensitive drum 30*a* for yellow is decelerated from the current rotational speed (initial speed). After that, in order to return the rotational speed to the initial speed, the rotational speed of the photosensitive drum 30*a* of yellow is accelerated. Then, when the acceleration is finished with the rotational speed returned to the initial speed, the eccentric position D of yellow is caused to coincide with the eccentric position B of black (S15). Here, the controller 11 operates as speed changing means.

Further, with respect to the color magenta, the phase difference is (1213−679=) 534 pulses because the predetermined position A with respect to the eccentric position B of black corresponds to the 1213th pulse, and the predetermined position E with respect to the eccentric position F of magenta corresponds to the 679th pulse. Accordingly, it is determined that the second rotational angle formed between the eccentric position B of black and the eccentric position F of magenta is smaller than the predetermined angle formed from the eccentric position B in the rotation direction (YES in S14), and the rotational speed of the photosensitive drum 30*b* for magenta is decelerated from the current rotational speed (initial speed). After that, in order to return the rotational speed to the initial speed, the rotational speed of the photosensitive drum 30*b* for magenta is accelerated. Then, when the acceleration is finished with the rotational speed returned to the initial speed, the eccentric position F of magenta is caused to coincide with the eccentric position B of black (S15).

Further, with respect to the color cyan, the phase difference is (1213−388=) 825 pulses because the predetermined position A with respect to the eccentric position B of black corresponds to the 1213th pulse, and the predetermined position G with respect to the eccentric position H of cyan corresponds to the 388th pulse. Accordingly, it is determined that the second rotational angle formed between the eccentric position B of black and the eccentric position H of cyan is smaller than the predetermined angle formed from the eccentric position B in the rotation direction (NO in S14), and the rotational speed of the photosensitive drum 30*c* of cyan is accelerated from the current rotational speed (initial speed). After that, in order to return the rotational speed to the initial speed, the rotational speed of the photosensitive drum 30*c* of cyan is decelerated. Then, when the deceleration is finished with the rotational speed returned to the initial speed, the eccentric position H of cyan is caused to coincide with the eccentric position B of black (S16).

In the above-mentioned embodiment, the eccentric positions D, F, and H are caused to coincide with the eccentric position B.

In addition, in another embodiment, by deriving an arbitrary position Z that allows alignment fastest from the eccentric positions B, D, F, and H, the eccentric positions B, D, F, and H may be caused to coincide with the arbitrary position Z.

An example of how to decide the reference position is described based on FIG. 9 as noted below. It is assumed that the predetermined positions are determined to be positioned at the uppermost position (i.e. 12 O'clock position) of the circumferences. FIGS. 18 and 19 shows the predetermined positions of image carriers (A, C, E, G (FIG. 9)) described with respect to a single image carrier. FIG. 19 shows an arbitrary position Z. The phase differences between the adjacent eccentric positions are now described. The phase difference between the eccentric positions B and F on the circumference of the each image carrier is 534 pulses. The phase difference between the eccentric positions F and D on the circumference of the each image carrier is 194 pulses. The phase difference between the eccentric positions D and H on the circumference of the each image carrier is 97 pulses. The phase difference between the eccentric positions H and B on the circumference of the each image carrier is 631 pulses. The 631 pulse phase difference between B and H is the largest number. In this case the arbitrary position Z is an intermediate point between eccentric positions H and B on the circumference of the each image carrier. The intermediate point is calculated according to the following equation (1456 (all circumferences)−631 (difference between B and H))/2=413 (see FIG. 19).

Then, the controller causes the respective eccentric positions B, D, F, and H to coincide with the arbitrary position Z by controlling the rotational speed.

Accordingly, it becomes possible to perform the phase alignment in a shortest time.

The accompanying drawings (FIGS. 9, 18, and 19) merely show one example in accordance with an embodiment of the present invention, and the present invention is not limited to the illustrated embodiment.

As described above, the digital multifunction peripheral 10 stores the phase differences between the predetermined positions A, C, E, and G and the eccentric positions B, D, F, and H, respectively. Then, by detecting the rotation angles of the photosensitive drums 30*a* to 30*d*, the stored phase differences are used to cause the eccentric positions on the circumferences of the photosensitive drums 30*a* to 30*d* to coincide with one another among the plurality of photosensitive drums 30*a* to 30*d*. Therefore, the phase alignment may be performed at an arbitrary time, and there is no need to cause the photosensitive drums 30*a* to 30*d* to stop rotating. Accordingly, it is possible to appropriately perform the phase alignment on the plurality of photosensitive drums 30*a* to 30*d* in a short time.

Further, to cause the eccentric positions on the circumferences of the photosensitive drums 30*a* to 30*d* to coincide with one another among the plurality of photosensitive drums 30*a* to 30*d*, the digital multifunction peripheral 10 determines whether or not the eccentric position deviates by the angle larger than the predetermined angle. Then, the rotational speed of each of the photosensitive drums 30*b* to 30*d* is changed according to the result obtained by the determination. Accordingly, the rotational speed of each of the photosensitive drums 30*b* to 30*d* may be changed according to a size of the angle by which the eccentric position deviates, which makes it possible to appropriately perform the phase alignment on the plurality of photosensitive drums 30*a* to 30*d* in a short time.

Further, in such a method of synchronizing rotations of the photosensitive drums 30*a* to 30*d*, in which the eccentric positions of the photosensitive drums 30*a* to 30*d* for the respective colors are synchronized, there is no need to cause the photosensitive drums 30*a* to 30*d* to stop rotating, and the eccentric positions on the circumferences of the plurality of photosensitive drums 30*a* to 30*d* are synchronized while the photosensitive drums 30*a* to 30*d* are kept rotating. Accordingly, it is possible to appropriately perform the phase alignment on the plurality of photosensitive drums 30*a* to 30*d* in a short time.

Note that in the above-mentioned embodiment, the description is made by taking the example in which the eccentric position B of black is set as the reference to cause the eccentric positions D, F, and H for the other colors of yellow, magenta, and cyan, respectively, to coincide with the eccentric position B of black. However, the present invention is not limited thereto and the eccentric position for another color may be set as the reference.

Further, in the above-mentioned embodiment, the entire circumference of the photosensitive drum is divided into 30 segments, but the present invention is not limited thereto, and the entire circumference may be divided into, for example, 2 segments or any number of segments.

Further, in the above-mentioned embodiment, the motor 43 and the encoder 42 are arranged along the same axis as the rotation shaft, but the present invention is not limited thereto, and if a speed reduction ratio is fixed, the motor 43 and the encoder 42 may be arranged along axes of different rotation shafts.

Further, in the above-mentioned embodiment, the first detector 35 for detecting the predetermined position on the photosensitive drum and the encoder 42 (the second detector) for detecting the rotation angle on the photosensitive drum are described as independent components. In addition, in another embodiment, by providing the encoder 42 with functionality for detecting the predetermined position on the photosensitive drum, the first detector 35 and the second detector may be combined as the third detector.

For example, a specific slit may be added between slits in a rotating disc of the encoder 42 (the second detector) at a position corresponding to a predetermined position on the photosensitive drum. The encoder 42 reads the specific slit to thereby detect the predetermined position on the photosensitive drum. Such a configuration allows the detecting portion 35 (the first detector) and the encoder 42 (the second detector) to be combined.

Accordingly, it is possible to perform the phase alignment on the plurality of photosensitive drums in a short time, and also to realize cost reduction and downsizing.

Further, in the above-mentioned embodiment, the encoder 42 is used for detecting the rotation angles of the photosensitive drums 30*a* to 30*d*, but the present invention is not limited thereto, and the rotation angles of the photosensitive drums 30*a* to 30*d* may be detected by employing a DC brushless motor as the motor 43 and by using a frequency generator (FG) pulse signal from the DC brushless motor.

Further, in the above-mentioned embodiment, the image forming device 16 includes the photosensitive members 30*a* to 30*d* for the four colors of yellow, magenta, cyan, and black, but the present invention is not limited thereto, and the image forming device 16 may include, for example, photosensitive drums for two colors of magenta and black.

Further, in the above-mentioned embodiment, the rotational speed of the photosensitive drum 30*a* for yellow is decelerated from the current rotational speed in an amount corresponding to the phase difference between the eccentric position B of black and the eccentric position D of yellow being 728 pulses, that is, the same value as 728 corresponding to the angle of the semicircle. However, the present invention is not limited thereto, and the rotational speed of the photosensitive drum 30*a* for yellow instead may be accelerated from the current rotational speed.

Further, in the above-mentioned embodiment, the predetermined position serving as the reference for the rotation angle of the photosensitive drum 30*a* is a position at which light is blocked by the light blocking plate 41. However, the present invention is not limited thereto. For example, the predetermined position may be set ahead of the position at which light is blocked (by the light blocking plate 41) by a predetermined number of pulses.

In accordance with another embodiment, control is performed so that the initial speed may be restored when the phase alignment is finished. FIG. 10 is a flowchart illustrating this embodiment. FIGS. 1 to 10 pertain to this embodiment. Note that S21 to S26 are the same as S11 to S16 described above with reference to FIG. 6, and hence description thereof is omitted.

First, in S25, the control is performed so as to decelerate the rotational speed of the photosensitive drum 30*b* of magenta (i.e. a color other than black) from the current rotational speed and the eccentric position F of magenta to coincide with the eccentric position B of black (S25). At this time, the phase difference between the predetermined position A with respect to the eccentric position B of black and the predetermined position E with respect to the eccentric position F of magenta is (1213−679=) 534 pulses. Hence, the controller 11 decelerates the rotational speed from the current rotational speed up to a position corresponding to half the phase difference ((534÷2=) 267 pulses)(S27).

Then, when the position corresponding to 267 pulses is passed, the controller 11 accelerates the rotational speed from the current rotational speed up to a position corresponding to 534 pulses by a decelerated amount (S28). In other words, the control is performed so that the initial speed is restored by setting the deceleration amount to be equal to an acceleration amount. FIG. 11 is a diagram illustrating a change in rotational speed exhibited in the case where the deceleration amount is set to be equal to the acceleration amount.

Accordingly, the speed serving as a reference before the deceleration may be restored when the phase alignment is finished, which makes it possible to effectively perform the phase alignment.

Similarly, when the rotational speed of the photosensitive drum 30*c* for cyan (i.e. a color other than black) is accelerated from the current rotational speed (initial speed) and the eccentric position H of cyan is caused to coincide with the eccentric position B of black (S26), the phase difference between the predetermined position A with respect to the eccentric position B of black and the predetermined position G with respect to the eccentric position H of cyan is (1213−388=) 825 pulses. Thus, the controller 11 accelerates the rotational speed from the current rotational speed up to a position corresponding to half the phase difference ((825÷2=) 413 pulses) (S29).

Then, when the position corresponding to 413 pulses is passed, the controller 11 causes the rotational speed to decelerate from the current rotational speed to a position corresponding to 826 pulses by an accelerated amount (S30). In other words, the control is performed so that the initial speed is restored by setting the acceleration amount to be equal to a deceleration amount. FIG. 12 is a diagram illustrating a change in rotational speed exhibited in the case where the acceleration amount is set to be equal to the deceleration amount.

Next, a further embodiment is described, in which the phase alignment is performed on the photosensitive drums 30*a* to 30*d* for the respective colors by synchronizing the eccentric positions of the photosensitive drums 30*a* to 30*d* for the respective colors.

First, to cause the eccentric positions of the photosensitive drums 30*a* to 30*d* for the respective colors to coincide with one another, as described above, the rotational speeds of the photosensitive drums 30*a* to 30*d* are accelerated or decelerated. However, the rotational speeds of the photosensitive drums 30*a* to 30*d* have an upper speed limit and a lower speed limit, and cannot be accelerated to the upper speed limit or higher or decelerated to the lower speed limit or lower. As a result, it may take a longer period of time to cause the rotational speeds to coincide with one another.

FIG. 13 is a diagram similar to FIG. 11 that illustrates the case where the deceleration amount of the photosensitive member 30*b* for magenta is set to be equal to the acceleration amount thereof and where a lower speed limit is set. In FIG. 13, the chain double-dashed line indicates the lower speed limit of the photosensitive drum 30*b* for magenta. In this case, as can be seen by referring to FIGS. 11 and 13, the period of time necessary to perform the phase alignment becomes longer.

FIG. 14 is a flowchart illustrating a still further embodiment. FIGS. 1 to 14 are referenced to describe the further embodiment. S31 to S34 are the same as S11 to S14 described above by referring to FIG. 6 and are not described.

First, in S34, the controller 11 determines whether or not the second rotational angle formed between the eccentric position B of black and the eccentric position F of magenta (i.e. a color other than black) is smaller than the predetermined angle (S34). Since the predetermined angle is set as 180° (a semicircle), that equates to (1,456÷2=) 728 pulses.

In view of the above, the phase difference is (1213−679=) 534 pulses because the predetermined position A with respect to the eccentric position B of black corresponds to the 1213rd pulse, and the predetermined position E with respect to the eccentric position F of magenta corresponds to the 679th pulse. Accordingly, it is determined that the second rotational angle formed between the eccentric position B of black and the eccentric position F is smaller than the predetermined angle in the rotation direction (YES in S34), and the rotational speed of the photosensitive drum 30*b* for magenta is decelerated from the current rotational speed (initial speed). Then, the eccentric position B of black is controlled to coincide with the eccentric position F of magenta (S35).

However, as described above, the rotational speed is close to the lower speed limit, and hence it takes 1.5 seconds to perform the phase alignment (see FIG. 13). Therefore, the controller 11 changes the predetermined angle (S36). Specifically, the predetermined angle is changed from 180° to 90°. With the predetermined angle set as 90° of the semicircle, there are (1×1,456÷4=) 364 pulses. Here, the controller 11 operates as an angle changing means.

Subsequently, it is determined that the second rotational angle formed between the eccentric position B of black and the eccentric position F is smaller than the predetermined angle in the rotation direction (NO in S34). Thus, the rotational speed of the photosensitive drum 30*b* of magenta is accelerated from the current rotational speed (initial speed), to cause the eccentric position F of magenta to coincide with the eccentric position B of black (S37).

FIG. 15 is a diagram illustrating a change in rotational speed exhibited in the case where the deceleration amount of the photosensitive drum 30*b* for magenta is set to be equal to the acceleration amount thereof and in a case where the phase alignment is performed by accelerating the rotational speed. In this case, as shown in FIG. 15, it takes 1.2 seconds to perform the phase alignment. Therefore, the phase alignment may be performed in a period of time shorter by 0.3 (=1.5−1.2) seconds (see FIGS. 13 and 15).

Accordingly, it is possible to perform the phase alignment by changing the predetermined angle to such an angle as to allow the phase alignment to be performed in a shorter period of time. In addition, it is possible to perform the phase alignment on the plurality of photosensitive drums 30*a* to 30*d* at an appropriate speed that does not exceed the upper speed limit or the lower speed limit.

Next, a further embodiment is described, in which the phase alignment is performed on the photosensitive drums 30*a* to 30*d* for the respective colors by synchronizing the eccentric positions of the photosensitive drums 30*a* to 30*d* for the respective colors during the start-up time for the image forming apparatus. Note that the time of start-up represents a state during which the rotational speed of the motor 43 increases from a stopped state (i.e. a rotational speed of 0) up to the normal speed.

FIG. 16 is a flowchart illustrating the case where the pertinent phase alignment is performed during the start-up time for the image forming apparatus. S41 to S46 are the same as S11 to S16 described above by referring to FIG. 6, and hence description thereof is omitted.

As shown in FIGS. 1 to 16, first, in S46, the rotational speed of the photosensitive drum 30*c* of cyan (i.e. a color other than black) is accelerated from the current rotational speed (initial speed) and the eccentric position H of cyan is caused to coincide with the eccentric position B of black (S46). Here, during a start-up time for the image forming apparatus, the rotational speed is accelerated by causing the current rotational speed (initial speed) to follow a target speed. The target speed is corrected by a predetermined correction amount based on the phase difference (S47).

FIG. 17 is a table illustrating target speeds each specifically representing the number of pulses of the pulse signal serving as a target value to be output from the encoder 42. The number of pulses of the pulse signal is inversely proportional to the rotational speed. Therefore, the number of pulses of the pulse signal is 22,109 at a lower speed time immediately after the start of the rotation, gradually becomes smaller as the rotation speed is nearer the normal speed, and is 3,736 in the normal state.

The predetermined correction amount is changed according to the target speed illustrated in FIG. 17. Specifically, the predetermined correction amount is changed by dividing the target value by, for example, 128. If the target value is 22,109, its corresponding target value is (22,109÷128=) 173, and if the target value is 3,736, its corresponding target value is (3,736÷128=) 29. Therefore, predetermined correction amounts are set in a ratio according to the target speed. In other words, by using the above-mentioned correction amounts, no matter which point in time the correction is performed from the start of the start-up until the target speed is reached, the eccentric positions D, F, and H for the other colors approach the eccentric position B of black by the same number of pulses. Note that FIG. 17 illustrates the six-level numerical values merely as a list of typical numerical values, and the changing of the predetermined correction amount is performed as appropriate. In other words, the changing of the predetermined correction amount is performed also on, for example, a target speed between 22,109 and 7,933.

Accordingly, even if the target speed is changed, the predetermined correction amount may also be changed in accordance therewith, and hence the predetermined correction amounts may be set in the ratio according to the target speed. As a result, it is possible to appropriately perform the phase alignment in a short period of time even during the start-up time for the image forming apparatus.

Note that in the above-mentioned embodiment, the predetermined correction amount is calculated by dividing the target value by an example value of 128, but the present invention is not limited thereto, and the target value may be divided by an arbitrary value.

Further, in the embodiment, the description of the image carriers is made by taking the photosensitive drums as an example, but the present invention is not limited thereto, and is naturally applied to a photosensitive belt or the like supported by a plurality of rollers as well.

In addition, in the case of a photosensitive belt, with the rollers that support the photosensitive belt being set as the image carrier, the present invention may be applied similarly to the eccentric position of the rollers.

Hereinabove, the accompanying drawings have been referenced to describe the embodiment of the present invention, but the present invention is not limited to the illustrated embodiment. Various modifications and changes may be made to the illustrated embodiment within the same scope as that of the present invention or within a scope equivalent thereto.

What is claimed is:

1. An image forming apparatus comprising:

a plurality of image carriers that are rotated in the same direction in synchronization with one another, wherein each image carrier within the plurality of image carriers has a circumference associated therewith;

a first detector for each image carrier within the plurality of image carriers that detects a predetermined position on the circumference of the respective image carrier;

a memory that stores a phase difference for each image carrier within the plurality of image carriers, the phase difference being between the respective predetermined position and a respective eccentric position on the circumference of each image carrier within the plurality of image carriers; and a controller that controls the eccentric positions on the circumferences of the image carriers to coincide in rotational position with one another by using the phase differences stored in the memory, thereby preventing misregistration, wherein the plurality of the image carriers comprises:

a first image carrier; and a second image carrier that is rotated in synchronization with a rotation of the first image carrier, and wherein the controller comprises:

a determination unit that determines whether or not a second rotational angle formed between the eccentric position of the first image carrier and the eccentric position of the second image carrier is smaller than a predetermined angle; and a speed controlling unit that controls a rotational speed of the second image carrier based on a determination result of the determination unit.

2. The image forming apparatus according to claim 1, wherein the predetermined angle comprises 180°.

3. The image forming apparatus according to claim 1, wherein the speed controlling unit controls the rotational speed of the second image carrier by adjusting the rotational speed by a predetermined, changeable amount.

4. The image forming apparatus according to claim 1, wherein the controller controls the eccentric positions of the plurality of image carriers to coincide with one another during a start-up time for the image forming apparatus.

5. The image forming apparatus according to claim 1, wherein the controller determines arbitrary positions of the plurality of image carriers and changes the rotational speed of the plurality of image carriers to cause the eccentric positions to coincide with the arbitrary positions.

6. The image forming apparatus according to claim 1, wherein the predetermined position detected by the first detector is in the same position as the eccentric position on the circumference of the image carrier.

7. The image forming apparatus according to claim 1, wherein the controller controls the eccentric positions on the circumferences of the image carriers to coincide with one another by accelerating or decelerating a rotational speed of at least one image carrier within the plurality of image carriers.

8. A method of synchronizing rotations of image carriers within an image forming apparatus, wherein the plurality of the image carriers comprises:

a first image carrier; and a second image carrier that is rotated in synchronization with a rotation of the first image carrier, the method comprising:

detecting a predetermined position on a circumference of each image carrier within a plurality of image carriers;

synchronizing eccentric positions on the circumferences of each image carrier to coincide in rotational position while rotating the plurality of image carriers to thereby prevent misregistration, wherein the synchronizing includes:

using phase differences between the predetermined positions and stored eccentric positions on the circumferences of the plurality of image carriers, determining whether or not an angle formed between the eccentric position of the first image carrier and the eccentric position of the second image carrier is smaller than a predetermined angle, and controlling a rotational speed of the second image carrier based on a determination result.

9. The method of claim 8, wherein the eccentric positions of the image carriers are controlled to coincide with one another during a start-up time for an apparatus.

10. The method of claim 8, wherein the detecting is performed using a position sensor located in the image forming device.

11. The method of claim 10, wherein the position sensor comprises a photo interrupter sensor and a light blocking plate.

12. The method of claim 8, wherein the synchronizing includes accelerating or decelerating a rotational speed of at least one image carrier within the plurality of image carriers.

13. An image forming apparatus, comprising:

a plurality of image carriers that are rotated in the same direction in synchronization with one another, wherein each image carrier within the plurality of image carriers has a circumference associated therewith;

at least one detector that detects a rotational position on at least one image carrier in the plurality of image carriers;

a memory that stores a phase difference between a predetermined position and an eccentric position on each image carrier in the plurality of image carriers; and a controller that controls the eccentric positions on the circumferences of the image carriers to coincide in rotational position with one another among the plurality of image carriers by using the phase differences stored in the memory, thereby preventing misregistration, wherein the plurality of image carriers comprises:

a first image carrier; and a second image carrier that is rotated in synchronization with the first image carrier, and wherein the controller comprises:

a determination unit that determines whether or not a second rotational angle formed between the eccentric position of the first image carrier and the eccentric position of the second image carrier is greater than a predetermined angle, and a speed controlling unit that changes a rotational speed of the second image carrier based on a determination result of the determination unit.

14. The image forming apparatus according to claim 13, wherein the at least one detector detects the predetermined position on the circumference of each image carrier within the plurality of image carriers and a first rotational angle formed in the rotational direction of the image carrier.

15. The image forming apparatus according to claim 13, wherein the at least one detector comprises a single detector that detects the rotational position on each image carrier within the plurality of image carriers.

16. The image forming apparatus according to claim 13, wherein the at least one detector comprises a plurality of detectors, and wherein each detector within the plurality of detectors detects the rotational position on at least one image carrier within the plurality of image carriers.

17. The image forming apparatus according to claim 13, wherein the controller determines arbitrary positions of the plurality of image carriers and changes the rotational speed of the plurality of image carriers to cause the eccentric positions to coincide with the arbitrary positions.

18. The image forming apparatus according to claim 13, wherein the controller controls the eccentric positions of the plurality of image carriers to coincide with one another during a start-up time for the image forming apparatus.

19. The image forming apparatus according to claim 13, wherein the predetermined position detected by the detector is in the same position as the eccentric position on the circumference of the image carrier.

20. The image forming apparatus according to claim 13, wherein the controller controls the eccentric positions on the circumferences of the image carriers to coincide with one another by accelerating or decelerating a rotational speed of at least one image carrier within the plurality of image carriers.

* * * * *